US005723835A

United States Patent [19]

Gilmore

[11] Patent Number: 5,723,835

[45] Date of Patent: Mar. 3, 1998

[54] COMPOSITE REED SWITCH-BRACKET

[76] Inventor: Glendell N. Gilmore, 13606 Boca Raton, Houston, Tex. 77069

[21] Appl. No.: 655,180

[22] Filed: May 29, 1996

Related U.S. Application Data

[63] Continuation-in-part of Ser. No. 412,729, Mar. 29, 1995, abandoned.

[51] Int. Cl.[6] ..... H01H 3/16; H01H 9/00

[52] U.S. Cl. ..... 200/61.71; 335/205

[58] Field of Search ..... 200/61.62, 61.71–61.75, 200/61.76–61.83, 61.93; 335/151, 205–207

[56] References Cited

U.S. PATENT DOCUMENTS

| | | | |
|---|---|---|---|
| 3,564,277 | 2/1971 | Maguire | 307/106 |
| 3,617,962 | 11/1971 | Wilson | 335/151 |
| 3,795,780 | 3/1974 | Lawrie | 200/61.45 R |
| 3,874,223 | 4/1975 | Miyazaki et al. | 73/32 R |
| 3,958,199 | 5/1976 | Seitz, Jr. et al. | 335/154 |
| 3,975,723 | 8/1976 | Bowling et al. | 200/61.71 |
| 4,219,773 | 8/1980 | Markfelt | 335/205 X |
| 4,232,309 | 11/1980 | Dillitzer | 200/61.62 X |
| 4,336,518 | 6/1982 | Holce et al. | 335/205 |
| 4,371,856 | 2/1983 | Holce et al. | 335/202 |
| 4,495,480 | 1/1985 | Martin et al. | 335/119 |
| 4,536,754 | 8/1985 | Holce et al. | 335/207 X |
| 4,595,897 | 6/1986 | Amano et al. | 335/205 |
| 5,004,879 | 4/1991 | Bernhardt et al. | 200/295 |
| 5,388,825 | 2/1995 | Myers et al. | 273/58 G |
| 5,440,084 | 8/1995 | Fuse et al. | 200/61.45 R |

OTHER PUBLICATIONS

Moskowitz, Lester R., "Permanent Magnet Design and Application Handbook", pp. 213–214 (1976).

*Primary Examiner*—J. R. Scott

*Attorney, Agent, or Firm*—Pravel, Hewitt, Kimball & Krieger

[57] ABSTRACT

A composite reed switch-bracket which is suitable for mounting on conventional roll-up or overhead doors to avoid damage caused by shocks or alignment displacement of the reed switch during usage. The electric magnetically actuated switch is mounted with a non-magnetic bracket and the switch is enclosed in a close fitting rubber or cover to maintain the switch that is not securely fixed and that is suspended in a gas filled air pocket to prevent or minimize breakage of the glass reed or other enclosure of the switch during usage. This composite reed bracket switch is intended for use with any and all manufacturer's alarm products.

10 Claims, 5 Drawing Sheets

FIG. 1
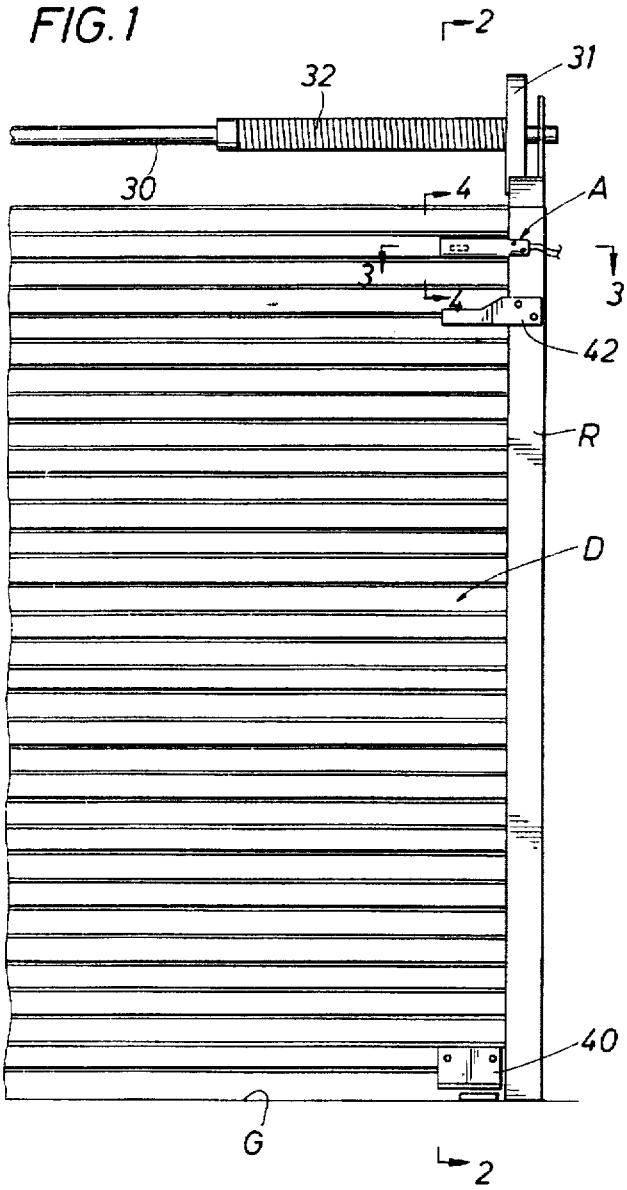
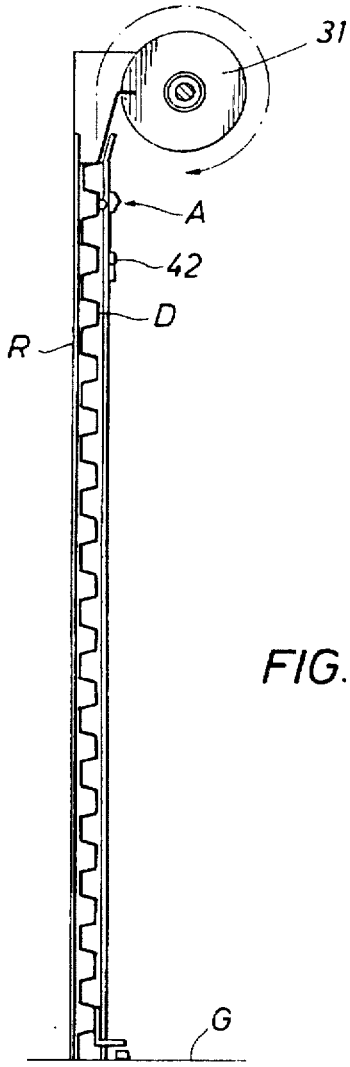
FIG. 2
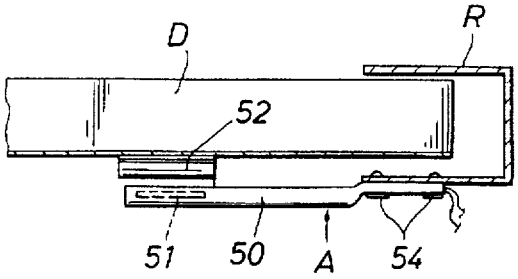
FIG. 3
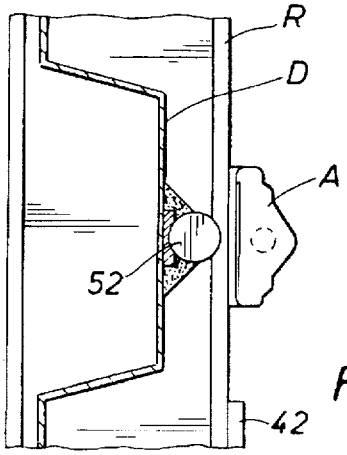
FIG. 4

FIG. 5
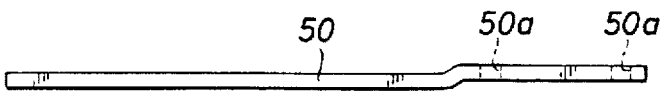
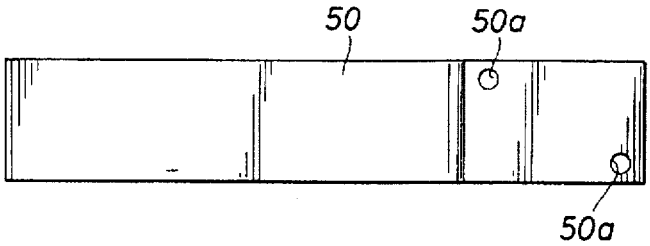
FIG. 6
FIG. 7
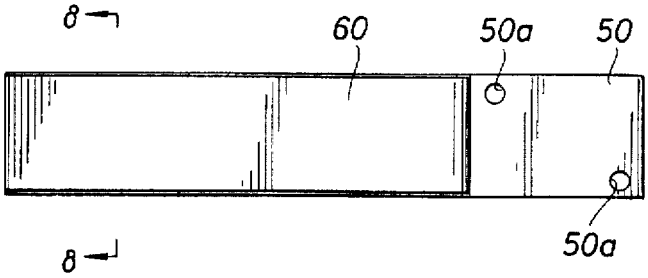
FIG. 8
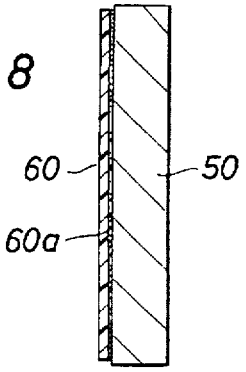
FIG. 9
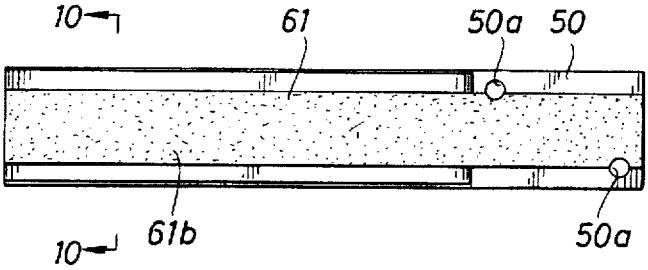
FIG. 10
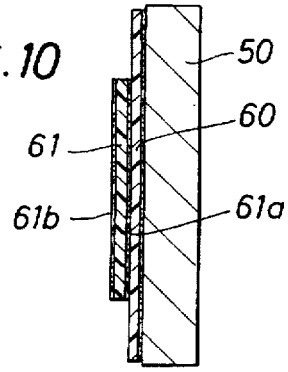
FIG. 11
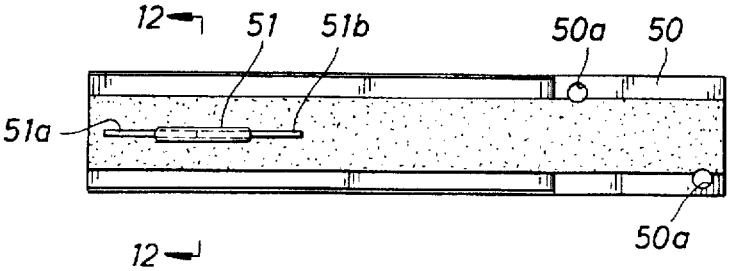
FIG. 12
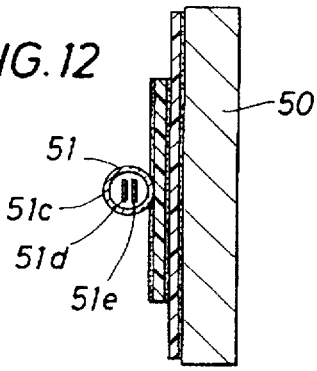

COMPOSITE REED SWITCH-BRACKET

CONTINUATION-IN-PART

This is a continuation-in-part of U.S. Ser. No. 08/412,729 filed Mar. 29, 1995 now abandoned.

FIELD OF THE INVENTION

This invention relates to a new and improved composite reed switch-bracket which is suitable for mounting on conventional roll-up or overhead doors to avoid damage often caused by shocks or displacements of the reed switch during usage. This is achieved by a unique mounting of the reed to the housing or bracket which is referred to herein as the "floating reed." The reed "floats" because it is not secured to any fixed material which takes care of shock related damage. The switch and bracket are one composite piece which takes care of displacements such as switch and magnet misalignments.

BACKGROUND OF THE INVENTION

Reed switches are a low voltage switch, generally in the one watt range, which are generally formed by a pair of spaced wire contacts mounted within an hermetically sealed glass enclosure, with the leads extending from the glass enclosure. The contacts are normally spaced apart when they are in close proximity to a magnet and they are moved toward each other to close the switch when the magnet is moved a certain distance from the switch. The switch can also be designed to be normally closed with the spaced wires in contact with each other and then upon the magnet coming in a close range to the wires, the wires can be caused to move apart or away from each other to open the switch. The particular way in which the switch operates is a matter of the location of the switch and the desired operating condition. A typical reed switch is shown and explained in a book, "permanent Magnet Design and Application Handbook," by Lester R. Moskowitz, published in 1976.

In the past, reed switches have generally been mounted on the floor of the building where an overhead or roll-up door is located to provide a signal or an alarm electrically when the door is opened.

Mounting the reed switch on the floor of the building in which the overhead door is located, positions the reed switch in a very vulnerable position. For example, the switch may be damaged by being ripped off the floor, smashed by heavy equipment, or destroyed by shock when objects are dropped on it. If the reed switch is mounted on an overhead roll-up door itself rather than the floor, it is still vulnerable to being bent, torn off the door or even to falling off the door due to vibration that occurs when the door is rolled up and down. Further, with presently known devices, the switch and magnet often become misaligned so that the switch malfunctions. The magnet and the reed switch are separate items that are mounted separately, with the magnet normally being mounted on the door and the reed switch normally being mounted on the floor, often in a recess in the floor in proximity to the lower part of the overhead door when the door is in the down or closed position.

It is an object of the present invention to provide a composite bracket-reed switch mounting apparatus which is adapted to be mounted on the track of a segmented door such as a roll-up door for providing an electrical signal to one or more conventional alarm panels when the door is opened or is at a selected position, with the reed switch positioned at an elevated location from the floor with a shock resistant reed mounting apparatus that resists shock damage to the reed switch upon the opening and movement of the door.

Another object of the present invention is to provide a unitary bracket body of non-magnetic material which has first and second portions, the first portion adapted to be attached to a roll-up door track and with the second portion adapted to be positioned in close proximity to the door, and with a shock resistant mounting for a reed switch which is actuated by an induced magnetic field.

A further object of the invention is to provide a bracket-reed switch mounting apparatus in which a low voltage reed switch is secured to a portion of the bracket with a close-fit coating surrounding the switch and a pocket of air between the reed and the bracket material that provides the "floating reed" mounting with the bracket even when subjected to shock and contacts during the usage of the apparatus, particularly in connection with a roll-up door.

SUMMARY OF THE INVENTION

This invention relates to a new and improved composite reed switch-bracket which is suitable for mounting on conventional roll-up or overhead doors to avoid damage often caused by shocks or alignment displacement of the reed switch and magnet during usage. Of particular importance is the location of the reed switch-bracket on a guide track for the door in conjunction with a magnet for magnetically operating the electrical reed switch when the door is moved to an open position. Further, the switch-bracket of this invention is located relative to a stop for the door so that the door is stopped in its opening movement so that the stop for limiting the opening of the door is engaged without contact with the switch-bracket. The electric magnetically-actuated switch itself is mounted with the non-magnetic bracket so that it cannot move relative to the bracket and so that it is also prevented from receiving shocks which might be imparted thereto during the movements of the door. By reason of the secure mounting of the switch with the bracket and the ability to mount the switch-bracket on the door guide track at an elevated position from the ground level, the switch-bracket is in a position so that it is not exposed to external forces that might cause the switch to be misaligned or damaged with respect to the magnet or pulled or torn from the mounting during usage.

BRIEF DESCRIPTION OF THE DRAWINGS

FIG. 1 is a partial elevational view of the apparatus of this invention in use on a roll-up door, with the right hand portion of the door being illustrated with the right hand portion of the door guide track, with the door closed;

FIGS. 5–20 are illustrations of the present invention in the sequence in which the composite switch-bracket is manufactured in the preferred embodiment;

FIGS. 1A–6A are views corresponding to FIGS. 1–6, respectively, but showing the preferred embodiment;

DETAILED DESCRIPTION OF PREFERRED EMBODIMENT

Figure 1A:
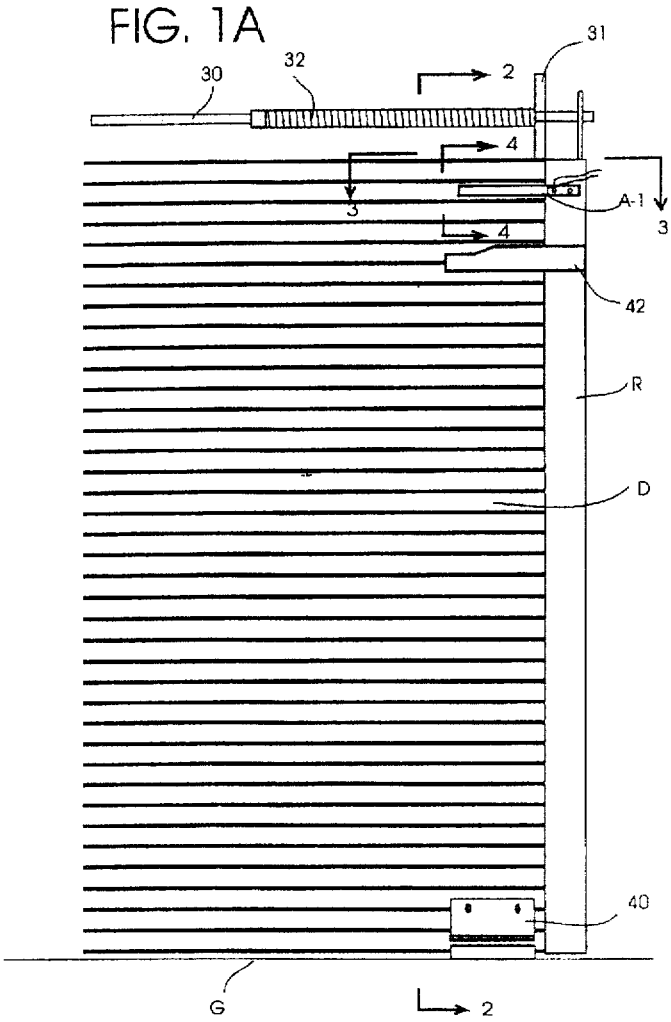
Figure 2A:
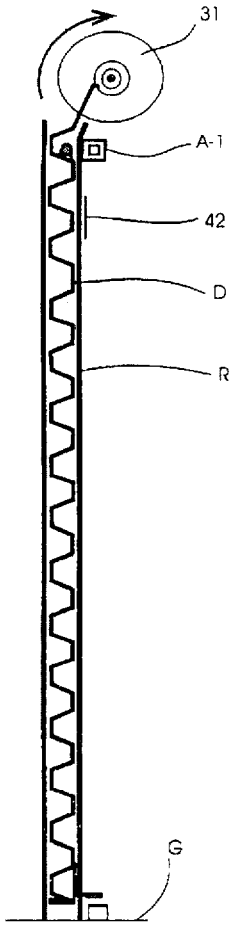
FIG. 2 is a side view taken on line 2—2 of FIG. 1.
Figure 3A:
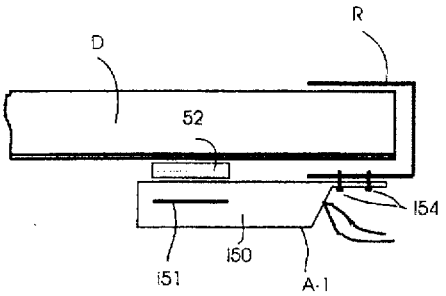
FIG. 3 is a partial view taken on line 3—3 of FIG. 1 to particularly illustrate the relationship of the components of the composite switch-bracket in the preferred embodiment.
Figure 4A:
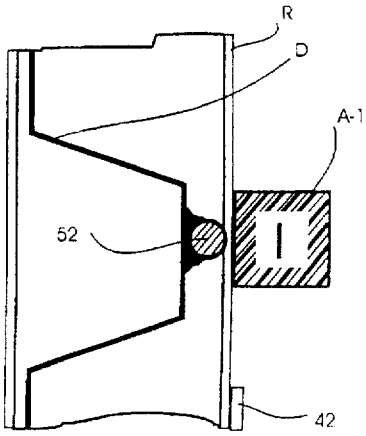
FIG. 4 is a view taken on line 4—4 of FIG. 1 to further illustrate the relationship of the magnet and the composite switch-bracket of this invention in position when the switch is normally closed.

In the drawings, the letters A (FIGS. 1–20)and A-1 (FIGS. 1A–10A) designate generally the composite switch-bracket of this invention which is adapted to be mounted on a guide track R of a roll-up door D. The door D is preferably of the roll-up type which is flexible enough to bend as it moves from its normally closed substantially vertical position to its rolled-up position at the top of the track. As illustrated in FIG. 2, the door D may be of the corrugated type which permits it to coil up on a rotatable support rod 30, in a similar manner to winding up a window shade in the conventional manner. A disc 31 is mounted on each end of the rotatable support rod 30 for retaining each end of the door D as it is wound up. For winding up the door D on support rod 30, a motor (not shown) may be suitably connected to the rod 30 in any known manner. A wind-up spring may be enclosed in a housing 32 to either cause the wind-up of the door D or to control the speed of such wind-up. Although the door D is illustrated as being a corrugated flexible door, it could take other forms which are known such as hinged segmental door strips (not shown). The door D may be formed of metal, plastic, or any other suitable flexible material.

In the usual manner, a stop 40 is attached to the bottom of the door D to limit the extent of the upward movement of the door D as it moves to an open position by engagement with a fixed stop member 42 which is preferably secured to the track R by screws, bolts, or other suitable fastening means. The track R preferably is a channel member having a U-shape for receiving the ends of the door D so as to guide the door as it moves both upwardly and downwardly relative to the ground G.

Referring now to FIG. 3, the composite switch-bracket A is shown with its three basic components, namely, a non-magnetic bracket body 50, a magnetically-actuated reed switch 51, and a magnet 52. The reed switch 51 itself is a well known type of switch which is operated by magnetic induction to open or close the switch depending upon whether or not the magnetic field from magnet 52 is in proximity to the switch 51. An illustration and description of a well known reed switch is disclosed in a book entitled "permanent Magnet Design and Application Handbook," by Lester R. Moskowitz, pages 212 and 213, published in 1976. In the present invention, the switch operates in the five watt range. Reed switches are conventionally made of two strips or reeds of electrical conductor nickel-iron wires that are spaced from each other when they are in the open position and are in contact with each other in the closed position. They are small and fine enough so that they are actuated by a magnetic field through magnetic induction. Typically, the contacts of the reed switch are enclosed in a hermetically sealed envelope formed of glass. They are therefore very fragile and susceptible of being broken when subjected to shocks in usage.

The magnet 52 is preferably an Alnico magnet which is known to be suitable for operating the reed switch. The bracket 50 is made of aluminum of other non-magnetic material so that it does not interfere with the magnetic switch action of the reed switch 51. In addition, the material of the bracket 50 must be strong enough and rigid enough so that it maintains its position when mounted on the door track R with screws 54 or other suitable fastening means.

Figure 5A:
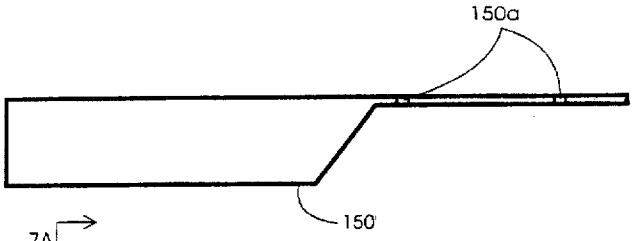
Figure 6A:
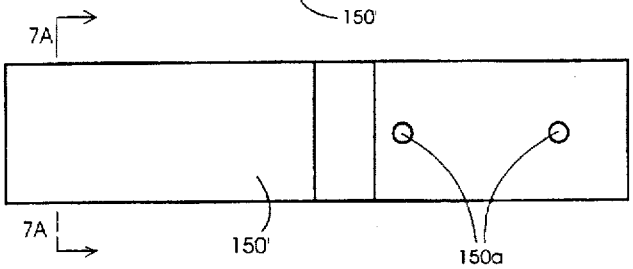

In the preferred embodiment of the present invention, as illustrated in FIGS. 1A–10A, the bracket 150', shown in FIGS. 5A and 6A is formed of tubular non-magnetic material such as aluminum or plastic.

Figure 7A:
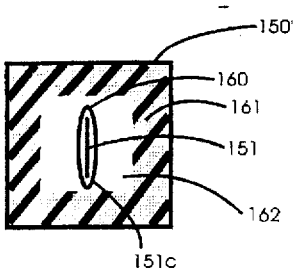
FIG. 7A is an end view taken on cut line 7A—7A of FIG. 6A.
Figure 8A:
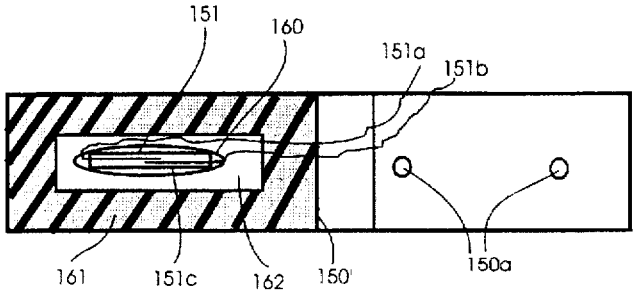
FIG. 8A is a view corresponding to FIG. 6A, but showing the left hand portion in section.

As shown in FIGS. 7A and 8A, a rubber material 160 encapsulates the glass reed switch 151. A body 161 of resilient material such as a poly-foam or polystyrene fit snugly in the interior of the tubular bracket or sleeve 150', and it is formed with an internal cavity 162 to provide an air pocket in the center of the poly-foam which houses the reed switch 151. The bracket 150' normally extends beyond the track of channel R when the composite switch-bracket of the invention is mounted on such track R. FIG. 7A is a view taken on line 7A—7A of FIG. 6A.

Figure 9A:
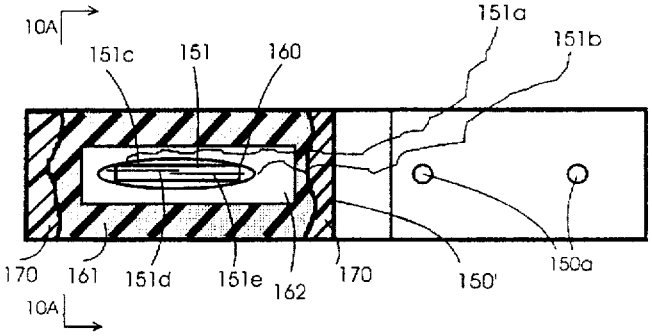
FIG. 9A is a view like FIG. 8A, but showing the final assembly.
Figure 10A:
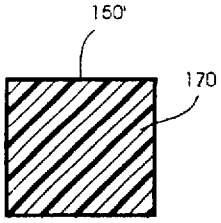
FIG. 10A is sectional view taken on line 10A—10A of FIG. 9A.

FIGS. 8A and 9A illustrate the next step in the manufacturing process of the present invention. The poly-foam 161 with reed switch 151 inserted in air pocket 162 is inserted into the inner cavity 162 of bracket 150'. FIGS. 9A and 10A show a further optional feature wherein, instead of just air in the cavity, another gas may be inserted. Thus, a silicone based product 170 is injected at both ends of the cavity 162 of the bracket 150'. During the silicone curing process an ammonia methanol gas blend is produced which fills the cavity of the bracket. The inner cavity is thus filled with such gas which stabilizes and minimizes the movement and shocks to the floating reed 151. As shown in FIG. 9A, the reed switch 151 has electrical leads **151*a* and 151*b* extending from the glass enclosure 151*c*. Electrical wires 151*d* and 151*e* of magnetic switch 151 are inside the glass enclosure 151*c* and are either connected to or integral with the electrical wires 151*a* and 151*b* located externally of enclosure 151*c***.

The electrical wires **151*a* and 151*b* are made of stiff enough electrically conductive metal to normally support the entire reed switch 151 in the floating position shown in the drawings. If there is a jarring of the unit A-1, the entire reed switch 151 with its glass enclosure may move in the cavity 162**, and in some instances even contact the resilient poly-foam, but without damage to the switch glass enclosure or reed contacts.

The leads **151*a* and 151*b* in the reed switch are preferably electrically connected by solder or other suitable means to the reed 151 and then extend beyond bracket 150'** for connection to a suitable control panel or unit for an alarm system (not shown) of conventional construction.

FIGS. 9A and 10A illustrate the step in the construction of the preferred form of the present invention wherein silicone 170 is injected at each end of the sleeve 150'.

In the use of the apparatus A-1 of this invention, it is mounted in an elevated position with respect to the floor or ground level G which in most instances will be about seven feet above such level so that the switch 151 is positioned away from most of the potential objects that would contact the switch during usage. This is a distinct advantage as compared to the conventional constructions and uses of reed switches wherein the reed switch is usually located near the ground level G and is therefore in a very vulnerable position to be damaged and is in fact often damaged and rendered unusable.

By providing the composite reed switch and bracket as a unit, it can be mounted on the track of the roll-up door so that the reed switch itself is held in a position in proximity to the magnet 52 when the door D is in the closed position (FIGS. 1A–3A).

In the normal operation, when the magnet 52 is adjacent the switch 151 as illustrated in pigs. 1A–3A, the switch 151 is in the closed position with the contacts 151*d* and 151*e* (FIG. 9A) engaging each other so that there is an electrical circuit complete to the alarm system through the electrical wires 151*a* and 151*b*. However, upon movement of the door D from its closed position of FIG. 1A upwardly towards an open position, the magnet 52 moves upwardly and away from the reed switch 151 so that its magnetic inductance causes the contacts 151*d* and 151*e* to separate from each other to open the electrical circuit through wires 151*a* and 151*b* to the alarm (not shown) which is thus triggered.

Upon closing of the door D, the magnet 52 moves back into the position adjacent the switch 151 to thereby close the contacts 151*d* and 151*e* by magnetic inductance so that the switch is closed and the alarm is deactivated. The switch can instead be open when the alarm is activated, so that the reverse operation occurs.

In another embodiment of the present invention, as illustrated in FIGS. 1–20, the bracket 50 is formed of aluminum or other suitable non-magnetic material and is provided with suitable openings 50*a* (FIGS. 5 and 6) for receiving screws or other fastening means 54 (FIG. 3).

As shown in FIGS. 7 and 8, a first electrical insulating layer 60 is secured by adhesive 60*a* to a portion of the bracket 50 which normally extends beyond the track of channel R when the composite switch bracket of the invention is mounted on such track R.

FIGS. 9 and 10 illustrate the next step in the manufacture of the present invention with FIG. 10 being taken on line 10—10 of FIG. 9o An elongate strip 61 which has adhesive on both sides is positioned on the insulating material 60 and preferably extends to the rest of the bracket 50 as shown in FIG. 9. The adhesive coated sides 61*a* and 61*b* provide for the adhesion of the layer 61 to the layer 60 and also an adhesive surface 61*b* to which a reed switch 51 is mounted as shown in FIGS. 11 and 12. FIG. 12 is a view taken on line 12—12 of FIG. 11. As shown in FIG. 11, the reed switch 51 has electrical leads 51*a* and 51*b* extending from the glass enclosure 51*c* (FIG. 12). Electrical contacts 51*d* and 51*e* of magnetic switch 51 shown in FIG. 12 are inside the glass enclosure 51*c* and are either connected to or integral with the electrical leads 51*a* and 51*b* located externally of enclosure 51*c*.

Figure 13:
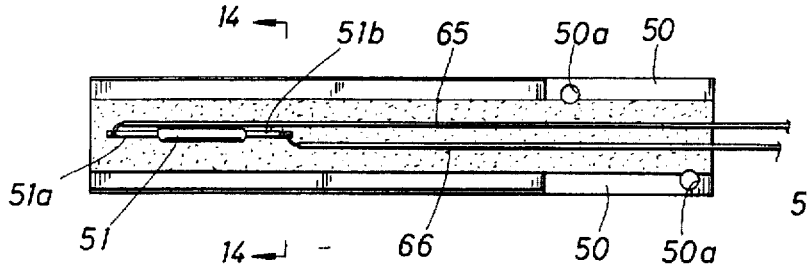
Figure 14:
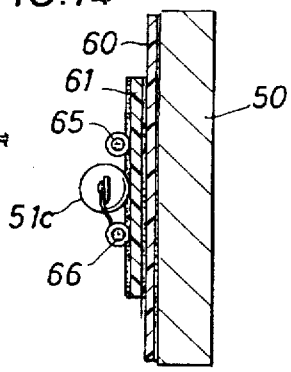

As shown in FIGS. 13 and 14, the leads 51*a* and 51*b* in the reed switch are electrically connected by solder or other suitable means to electrical wires 65 and 66 which extend lengthwise of the bracket 50 and then beyond the bracket 50 for connection to a suitable control panel or unit for the alarm system (not shown) of conventional construction. FIG. 14 is taken on line 14—14 of FIG. 13.

Figure 15:
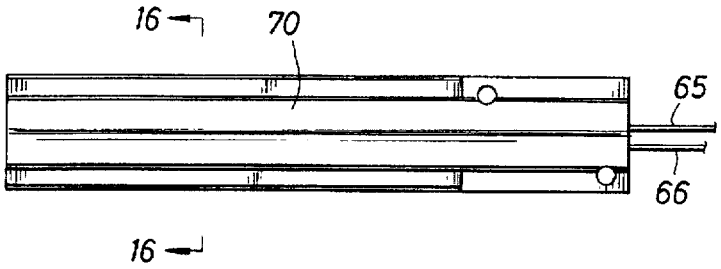
Figure 16:
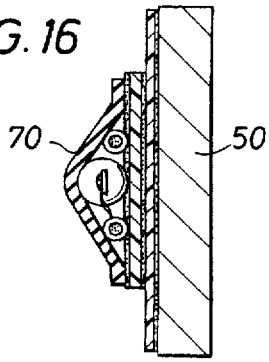

FIGS. 15 and 16 illustrate the next step in the construction of the present invention wherein a layer of plastic adhesive tape 70 is positioned over the reed switch 51 and preferably extends for the full length of the bracket 50 as seen in FIG. 15. FIG. 16 is a view taken on line 16—16 of FIG. 15. The layer 70 contains the switch 51 in its position during the subsequent steps and also provides additional insulation to protect the relatively fragile glass enclosure 51*c* of the reed switch 51 during usage.

Figure 17:
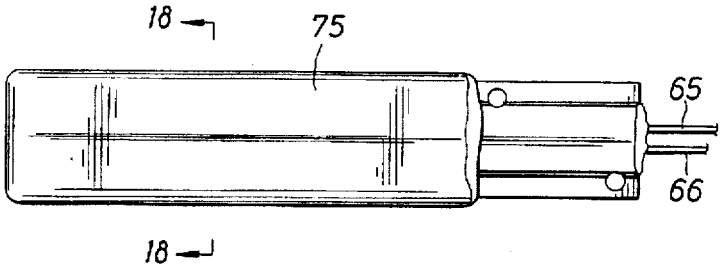
Figure 18:
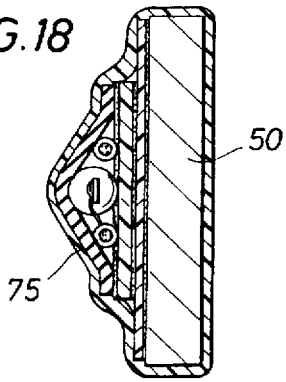

FIGS. 17 and 18 illustrate the switch 51 and a portion of the bracket 50 with a shrink-fit tube 75 which is placed around both the bracket and the switch in a relatively loose condition and then heated so that it shrinks to conform to and tightly enclose the switch in a relatively loose condition and then heated so that it shrinks to conform to and tightly enclose the switch on the bracket for substantially the full length of the bracket so that the switch cannot move relative to the bracket in usage. The heat-shrink enclosure may be made of any known plastic or other material which shrinks on heating.

Figure 19:
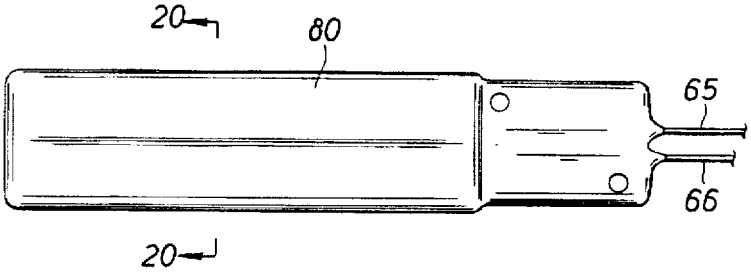
Figure 20:
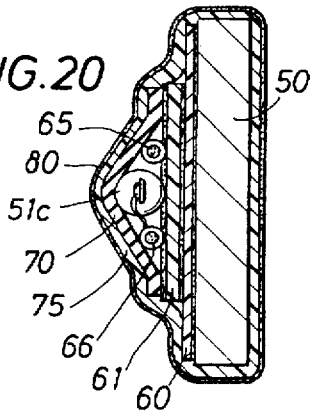

A final layer 80 of rubber is applied to the entire composite switch-bracket so as to cover both and allow for the electrical wires 65 and 66 to extend therefrom as shown in FIGS. 19 and 20. FIG. 20 is a view taken on line 20—20 of FIG. 19. The rubber layer 80 is formed by dipping the composite switch-bracket into molten or liquified rubber and then allowing it to solidify upon cooling so that it conforms very closely around all of the components previously assembled to further enhance maintaining of the switch 51 relative to further enhance maintaining of the switch 51 relative to the bracket 50 in use and to protect the switch 51 from shocks and other damage that might cause breakage of the glass 51*c* of the switch 51.

In the use of the apparatus A of this invention, it is mounted in an elevated position with respect to the floor or ground level G which in most instances will be about seven feet above such level so that the switch 51 is positioned away from most of the potential objects that would contact the switch during usage. This is a distinct advantage as compared to the conventional constructions and uses of reed switches wherein the reed switch is usually located near the ground level G and is therefore in a very vulnerable position to be damaged and is in fact often damaged and rendered unusable.

By providing the composite reed switch and bracket as a unit, it can be mounted on the track of the roll-up door so that the reed switch itself is held in a position in proximity to the magnet 52 when the door D is in the closed position (FIGS. 1–3).

In the normal operation, when the magnet 52 is adjacent the switch 51 as illustrated in FIGS. 1–3, the switch 51 is in the closed position with the contacts 51*d* and 51*e* (FIG. 12) engaging each other so that there is an electrical circuit complete to the alarm system through the electrical wires 65 and 66. However, upon movement of the door D from its closed position of FIG. 1 upwardly towards an open position, the magnet 52 moves upwardly and away from the reed switch 51 so that its magnetic inductance causes the contacts 51*d* and 51*e* to separate from each other to open the electrical circuit through wires 65 and 66 to the alarm (not shown) which is thus triggered.

Upon closing of the door D, the magnet 52 moves back into the position adjacent the switch 51 to thereby close the contacts 51*d* and 51*e* by magnetic inductance so that the switch is closed and the alarm is deactivated. The switch can instead be open when the alarm is activated, so that the reverse operation occurs.

Although the invention has been described with respect to a roll-up type door, it will be understood that the invention is applicable to other types of doors such as overhead doors which move on a vertical track to a horizontal track as used in garages and other storage places. The location of the composite switch-bracket and the magnet can be adjusted to accommodate different locations and different applications of the present invention.

Having described the invention above, various modifications of the techniques, procedures, material and equipment will be apparent to those in the art. It is intended that all such variations within the scope and spirit of the appended claims be embraced thereby.

What is claimed is:

1. A bracket-reed switch mounting apparatus adapted to be mounted on an elevated portion of a track for a vertically movable door for positioning the switch to provide an electrical signal when the door moves from a selected position, comprising:

a rigid non-magnetic bracket body having a first portion adapted to be attached to an elevated portion of a door track for a vertically movable door;

said body having a second portion which is adapted to be positioned substantially parallel to the plane of the door and in close proximity to a portion of the door when the door is in a selected position;

said second portion having a resilient material secured therein which has an internal gas pocket has a gaseous medium in which the reed switch is positioned in a floating suspension relative to said body to thereby minimize shock damage to said reed switch by external forces; and a magnet positioned with the door to activate the switch when the door is moved from said selected position.

2. The apparatus set forth in claim 1, wherein: the gas in said internal gas pocket is air.

3. The apparatus set forth in claim 1, wherein:

said second portion is a tubular sleeve and said resilient material substantially fills the interior portion of the tubular sleeve except for the portion of the tubular sleeve constituting the gas pocket.

4. The apparatus set forth in claim 3, including:

a sealant at each end of said sleeve.

5. The apparatus set forth in claim 4, wherein:

the sealant is a silicone which generates an ammonia methanol gas upon curing which fills said gas pocket.

6. The apparatus set forth in claim 1, wherein:

the resilient material is poly-foam.

7. The apparatus of claim 1, wherein:

said reed switch has wires extending therefrom and which are connected to external support wires which are stiff enough to provide the sole structural support for the reed switch and to normally hold the switch out of contact with the resilient material but permitting some movement thereof when subjected to external shock forces.

8. The apparatus of claim 1, wherein:

the reed switch has interval substantially parallel wires which are spaced from each other in an open switch position and in contact with each other in a closed switch position.

9. The apparatus of claim 1, wherein:

said first portion of said bracket body is formed in a generally rectangular shape with substantially flat substantially parallel surfaces for a portion of the length of the bracket for attachment to the track for the vertically movable door.

10. The apparatus of claim 1, including:

means with said first portion of the bracket for attaching the bracket to a guide track at an elevated position above ground level.

* * * * *

UNITED STATES PATENT AND TRADEMARK OFFICE

CERTIFICATE OF CORRECTION

PATENT NO. : 5,723,835

DATED : March 3, 1998

INVENTOR(S) : Glendell N. Gilmore

It is certified that error appears in the above-identified patent and that said Letters Patent is hereby corrected as shown below:

In column 7, line 12, insert -- which -- after "pocket"

Signed and Sealed this

Thirteenth Day of July, 1999

*Attest:*

*Attesting Officer*

Q. TODD DICKINSON

*Acting Commissioner of Patents and Trademarks*